United States Patent [19]

Munnikhuysen

[11] 4,218,777

[45] Aug. 26, 1980

[54] FACE PROTECTOR

[76] Inventor: Janetlee Munnikhuysen, 395 Young St., Wilson, N.Y. 14172

[21] Appl. No.: 923,918

[22] Filed: Jul. 12, 1978

[51] Int. Cl.[2] ..... A41D 13/00

[52] U.S. Cl. ..... 2/9; 2/174

[58] Field of Search ..... 2/204, 9, 174, 173, 2/206, 209, 12; 128/146, 141 R, 132 R, 136, 163, 205; 132/1 R, 88.5, 88.7, 9, 79 R; 32/34; D2/242

[56] References Cited

U.S. PATENT DOCUMENTS

| | | | |
|---|---|---|---|
| 167,543 | 9/1875 | Kleinert | 2/206 |
| 566,824 | 9/1896 | Wormer | 2/206 |
| 625,196 | 6/1900 | Shibe | 2/9 |
| 1,764,912 | 6/1930 | Caster-Udell | 2/174 |
| 2,159,435 | 5/1939 | Gribbin | 2/174 |
| 2,261,274 | 11/1941 | Owen | 2/174 |
| 2,625,684 | 1/1953 | Magnusson | 2/9 |
| 2,667,869 | 2/1954 | D'elia | 2/9 X |
| 3,060,445 | 10/1962 | Brockman | 2/9 |
| 3,261,027 | 7/1966 | Lambert | 2/174 |
| 3,319,262 | 5/1967 | Lee | 2/174 |
| 3,555,566 | 1/1971 | Gettinger | 2/204 |
| 3,963,034 | 6/1976 | Runberg et al. | 2/9 X |

*Primary Examiner*—Werner H. Schroeder
*Assistant Examiner*—Andrew M. Falik
*Attorney, Agent, or Firm*—Ashlan F. Harlan, Jr.

[57] ABSTRACT

A protector to prevent or minimize the contact of hair spray or the like on the face of a user which consists of a symmetrical strip of relatively thin, flexible material such as cardboard that has one straight longitudinal edge and another, irregular, longitudinal edge, the end portions of said irregular edge being straight and parallel with said straight longitudinal edge, the medial portion of said irregular edge being straight and parallel with said straight longitudinal edge, and said end portions and medial portion being connected by outwardly converging, sloping portions.

3 Claims, 3 Drawing Figures

FACE PROTECTOR

BACKGROUND OF THE INVENTION

This invention relates generally to a face protector and particularly is concerned with such devices as are used to prevent or minimize contact by sprays used on the hair for cosmetic or other purposes with the face of the user.

Sprays of solution or dispersions are widely employed on the hair either to hold it in a predetermined arrangement or to impart color thereto. In using such sprays there is necessarily a certain amount of overspray which may make contact with the face of the user. Since in many instances one or more of the ingredients in the spray product is irritating to the eyes or nose of the user or will leave undesirable deposits on the skin it is desirable to shield the face from overspray. It has been known, as exemplified by U.S. Pat. Nos. 3,015,105; 3,103,667; and 3,152,588 to F. J. Rogowski and U.S. Pat. No. 3,310,812 to G. F. Gaisser, to use face masks for protection during spraying. Such masks, however, are relatively expensive. Consequently, they are not suitable for use in beauty parlors and the like where, for sanitary reasons, a new mask is required or desirable for each customer. Moreover, in some cases the design of the mask is such as to cause some interference with the breathing of customers and to feel unduly confing to them. There has, therefore, been a need for a device which can be used to protect the face of a user from overspray during the application of hair spray or the like. Desirably such a device will be inexpensive so that it may be discarded after a single use, and will be easy to use. It is also desirable that the device be adapted for use with heads of differing shapes and sizes as well as adapted for manufacture in small and large sizes.

SUMMARY OF THE INVENTION

The above-recited desirable features are provided in the face protector disclosed herein. The protector consists of a symmetrical, relatively thin strip of flexible material such as cardboard, which has a maximum width that is approximately 1/5 of its length, the wide central portion having a length aproximately ⅓ of the length of the strip and the end, narrow portions each being approximately ⅛ the length of the strip and approximately ½ the maximum width. One longitudinal edge of the strip is substantially straight while the other longitudinal edge is irregular and comprises a central portion and two end portions that are parallel to each other and to the straight edge, and sloping, outwardly converging portions joining the end portions with the central or medial portion thereof.

THE INVENTION

Figure 3:
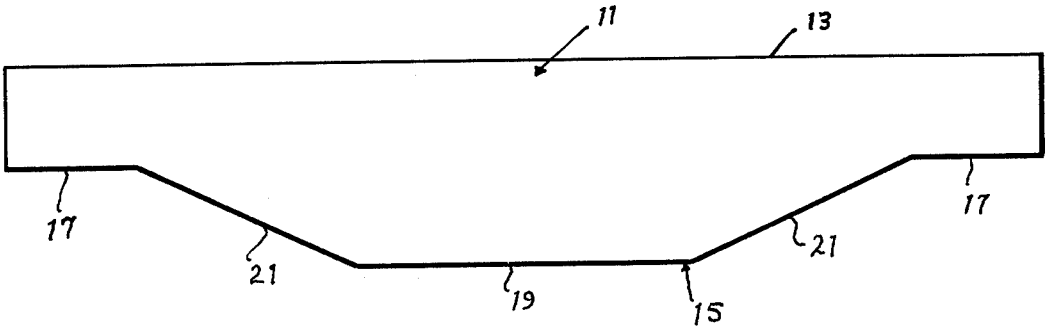
FIG. 3 is a plan view of the face protector shown in FIGS. 1 and 2.

The face protector of the present invention is exceedingly simple. It consists, as shown in FIG. 3 of a relatively thin strip 11 of flexible material such as a cardboard. The strip 11 is formed with one substantially straight longitudinal edge 13 and one irregular longitudinal edge 15. At each end of the strip 11 the edge 15 comprises two substantially equal portions 17 that are parallel with the edge 13 and the edge 15 also comprises a medial portion 19 that is parallel to the edge 13. The portions 17 and the portion 19 of the edge 15 are connected by sloping portions 21 that converge outwardly. Thus the strip 11 is symmetrical on either side of a line passing through the middle of the strip normal to the edge 13 and the medial portion 19 of the edge 15.

At its widest part the width of the strip 11 is approximately 1/5th its length while at its ends the width of the strip is approximately ½ its maximum width. The length of each of the end portions 17 of the irregular edge 15 is approximately ⅛ the length of the strip 11 and the medial portion 19 of the edge 15 is approximately ⅓ the length of the strip. These relative dimensions are not critical but are preferred and such relative dimensions tend to make use of the face protector easier.

Figure 1:
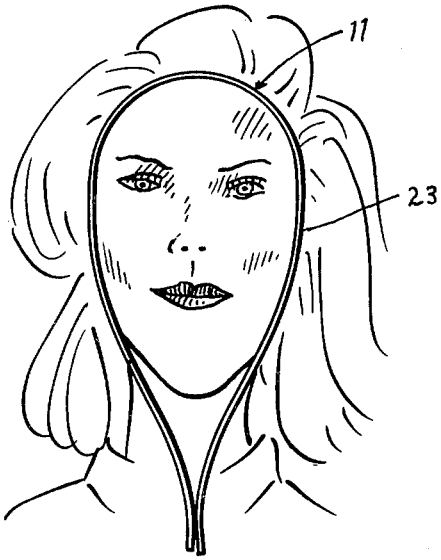
FIG. 1 is a front view illustrating the use on a person of a face protector according to the present invention.
Figure 2:
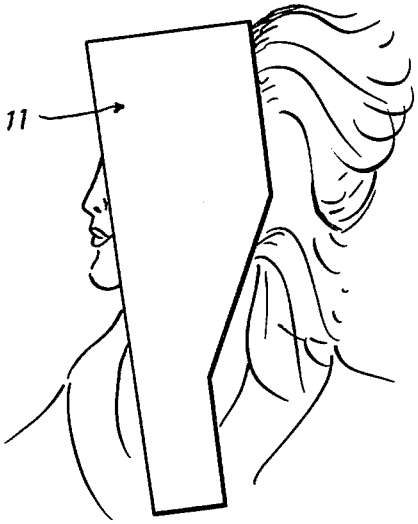
FIG. 2 is a side view of the subject shown in in FIG. 1.

As stated above, the strip 11 forming the protector of the present invention is flexible, the flexibility making its use possible. FIGS. 1 and 2 of the accompanying drawings illustrate the manner in which it is used. As shown in FIG. 1, the two end portions of the strip are brought together where they may be held by one hand. Alternatively they may be held together by a clip (not shown) or any other desired means. The loop 23 formed by the strip (see FIG. 1) slips over the face of the user, the irregular edge of the strip being disposed at the back (see FIG. 2) so as to expose as much of the user's hair as possible. A spray of desired composition can then be applied from a suitable spraying device (not shown) to the exposed hair for decorative effects or to hold the hair in place when exposed to wind. As will be seen from FIG. 2, spray directed at the exposed hair is prevented by the protector from directly contacting the face of a user, yet the protector can be shifted about enough so that substantially all the hair can be subjected to the spray.

After use, the protector can be discarded or not as desired. In hair dressing shops or beauty salons a fresh protector can be used for each customer. On the other hand, when used in the home a protector may, if desired, be used repeatedly, although, the protectors being so inexpensive, repeated use does not entail great savings.

As stated above, face protectors according to the present invention can be constructed of flexible cardboard. This is very inexpensive and ideal for the production of protectors that are intended for use only once. More durable protectors suitable for repeated use can be made from strips of flexible, sheet plastic materials such as polyethylene or polypropylene or fabric coated or impregnated with a suitable resin or elastomer. Such protectors can be used and reused indefinitely and, if necessary, cleaned from time to time as necessary. It will be appreciated that protectors according to the invention may carry messages and/or decoration on their relatively large surface areas. Consequently, they can be used for advertising purposes by beauty salons and/or manufactureres of distributors of hair-care products.

It will be understood that a face protector according to the invention may be used by persons with heads of varying size. It is, however, possible to make them of different sizes so that they may be used more easily by children and by persons with very large heads. In such cases, it is generally desirable to make the protectors substantially the same shape as shown in the drawings, but smaller or larger. Desirably, for use in general, the protector may be about 70 cm in length and have a maximum width of about 14 cm and a minimum width of about 7 cm. As shown in FIG. 1, the flexibility of the protector strip enables it to conform in use to faces of different shapes.

It will be understood that various modifications of the construction shown and described may be made without departing from the spirit of the present invention. The invention should therefore be interpreted as broadly as permitted by the accompanying claims.

I claim:

1. A face protector for protecting the face of a person during application of a spray to the hair while leaving exposed a major portion of the hair, said protector consisting of an imperforate strip of relatively thin, flexible material, said strip having one substantially straight longitudinal edge and one irregular longitudinal edge, the latter comprising a medial portion and end portions parallel to said straight longitudinal edge, said medial portion being approximately $\frac{1}{3}$ the length of said strip and each of said end portions being approximately $\frac{1}{8}$ the length of said strip, said end portions and said medial portion of said irregular edge being connected by straight sloping portions, each of the end portions of the strip having a width of approximately $\frac{1}{2}$ the maximum width of said strip and being free whereby they may be grasped and held together by the hand of a user to position said strip closely around the face with the medial portion of said strip resting on the hair and extending over the eyes and face of the user, said strip being symmetrical with respect to a line passing through the middle thereof normal to said straight edge and to the medial portion of said irregular edge.

2. A face protector as defined in claim 1 in which said strip is formed of cardboard.

3. A face protector as defined in claim 1 in which strip is formed of a sheet plastic material.

* * * * *